US005109879A

United States Patent [19]

Seidler

[11] Patent Number: 5,109,879

[45] Date of Patent: May 5, 1992

[54] SELF-MOLDING COSMETIC SAMPLER APPLICATOR

[76] Inventor: David Seidler, 69-10 108th St., Forest Hills, N.Y. 11375

[21] Appl. No.: 664,738

[22] Filed: Mar. 5, 1991

[51] Int. Cl.[5] ..... A45D 40/26

[52] U.S. Cl. ..... 132/320

[58] Field of Search ..... 132/320, 333, 286; 206/823; 426/134, 112, 115, 515

[56] References Cited

U.S. PATENT DOCUMENTS

| | | | |
|---|---|---|---|
| 3,453,056 | 7/1969 | Motsavage et al. | 132/320 X |
| 4,518,092 | 5/1985 | Contreras, Jr. | 206/823 X |
| 4,537,194 | 8/1985 | Hanson et al. | 426/66 X |
| 4,739,778 | 4/1988 | Christie | 132/320 |
| 4,754,874 | 7/1988 | Haney | 132/286 X |
| 5,031,647 | 7/1991 | Seidler | 132/320 |

*Primary Examiner*—John J. Wilson
*Assistant Examiner*—Jeffrey A. Smith
*Attorney, Agent, or Firm*—Blum Kaplan

[57] ABSTRACT

A sampler applicator for holding a predetermined amount of a spreadable-type product. The applicator includes a first member having a section forming a mold for the product. A second member is releaseably coupleable to the first member and includes an aperture in registration with the mold through which a predetermined amount of the product is inserted. The product assumes the shape of the mold and is anchored to the second member. The mold acts as a cover for the applicator.

19 Claims, 2 Drawing Sheets

SELF-MOLDING COSMETIC SAMPLER APPLICATOR

BACKGROUND OF THE INVENTION

The present invention is directed generally to a cosmetic sampler applicator device and, in particular, to a self-molding cosmetic sampler device particularly suited for use in providing samples of a creamy or gelled cosmetic which hardens after pouring such as lipstick, eyeshadow or the like.

When shopping for cosmetic products such as lipstick, eyeshadow or the like, consumers generally desire to test such products on their own skin in order to determine whether the particular color or shade thereof is appropriate or desirable depending on the characteristics of the user. In the past, stores which sell such cosmetic products have provided actual retail samples on their cosmetic counters for users to try. Apart from the unsightly appearance such samples attain after multiple uses, there is great concern of late about the spread of communicable diseases and the otherwise unsanitary conditions provided through multiple uses of the same product by different consumers. With this concern in mind, various jurisdictions have passed legislation prohibiting the reuse of cosmetic devices for sampling purposes and have required that individual, disposable samples be provided.

It is important in providing individual samples of a cosmetic product that the sampling devices be inexpensive to manufacture while being adapted to retain a sufficient amount of the product to allow at least one complete application. In my copending U.S. patent application Ser. No. 07/431,101, the disclosure of which is incorporated herein by reference, I disclose a plastic cosmetic sampler application which includes a well having a sharp edge into which the flowable product is poured to form a raised mound of the product.

It is also preferable when providing a lipstick sampler applicator which may contain more than a single application, that a replaceable cap or cover be provided to permit multiple uses. Accordingly, it is desired to provide a cosmetic sampler applicator which meets the criteria set forth above for hygienic sampling in a convenient and inexpensive package.

SUMMARY OF THE INVENTION

Generally speaking, in accordance with the present invention, a sampler applicator for holding a predetermined amount of a spreadable-type product for application by a user, is provided. The applicator includes a first member having a section forming a mold for the product. A second member is releaseably coupleable to the first member and includes an aperture in registration with the mold through which the predetermined amount of spreadable type product is inserted. The product assumes the shape of the mold when it is poured through the aperture and becomes coupled to the second member through the aperture. The mold can then be removed to expose the product for use and can be reapplied to act as a cover.

In a preferred embodiment, the applicator is formed from a thermoplastic material and the mold in the first member acts as a cover member which can be formed with the second member through a living hinge arrangement which releaseably seals the second member during storage. The second member is formed in such a manner as to anchor the product thereto through the aperture for easy removal from the mold. Hence, a neatly formed molded product is presented for application when the mold is removed. The mold is formed as part of the package itself. A clear label or other transparent window can be applied over the aperture in the second member to allow viewing of the product by the consumer without opening the package.

Accordingly, it is an object of the present invention to provide a self-molding sampler applicator.

Another object of the present invention is to provide an improved cosmetic sampler applicator which provides a neatly formed spreadable type cosmetic product, which is easy and inexpensive to manufacture.

A further object of the present invention is to provide cosmetic sampler device which is quick, easy and inexpensive to fill with a cosmetic product.

A still further object of the present invention is to provide a disposable cosmetic sampler applicator in which the mold for the product forms the cover for the applicator.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
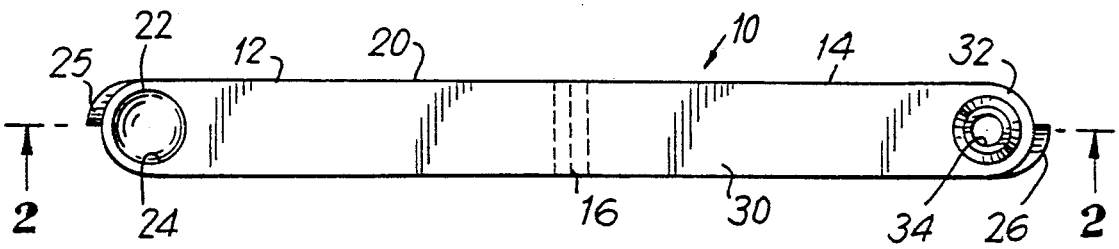
FIG. 1 is a top plan view of a cosmetic sampler applicator constructed in accordance with a preferred embodiment of the present invention.
Figure 2:
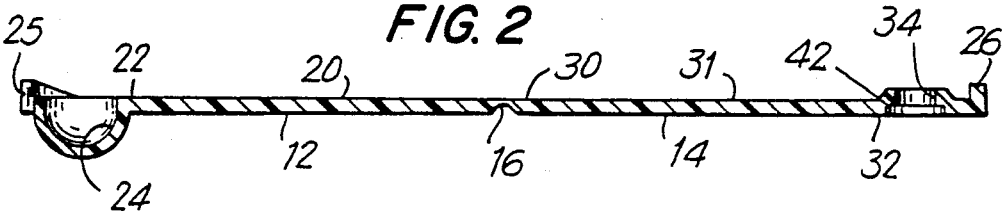
FIG. 2 is a sectional view taken along line 2—2 of FIG. 1 showing the applicator in open condition.
Figure 3:
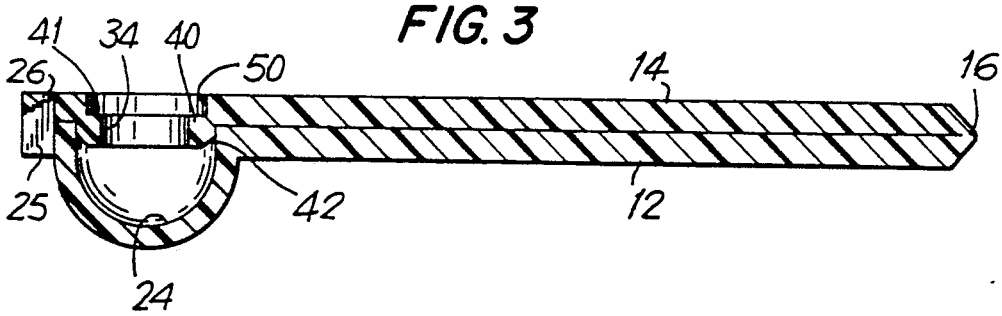
FIG. 3 is a sectional view similar to FIG. 2 shown with the applicator in a closed condition.

Reference is first made to FIGS. 1 through 3 of the drawings which depict a cosmetic sampler applicator, generally indicated at 10, constructed in accordance with a preferred embodiment of the present invention. Applicator 10 includes a first elongated member 12 and a second elongated member 14 hingedly coupled thereto through a living hinge 16. Applicator 10 is preferably formed of a thermoplastic material such as polypropylene, K-RESIN or the like, although it is recognized that other materials may be used to form the device.

First member 12 of applicator device 10 includes a first section 20 which may define a holding portion of the device and a second section 22 having a recessed portion 24 which acts as a mold and cover for a cosmetic or other product as more fully described below in detail.

Second member 14 includes a first section 30 which may also act as a holding portion for the device and a second section 32 which includes an aperture 34 therethrough. As explained below, aperture 34 acts both as an opening to fill mold 24 and as an anchor for the molded product.

Although first member 12 and second member 14 are shown hingedly joined by living hinge 16, it is noted that the members may be formed separately without a hinge, or other types of hinges may be used. When living hinge 16 is closed as depicted in FIG. 3, first member 12 is adjacent second member 14 and aperture 34 is in registration with mold 24. Opposing snap closures 25 and 26 on respective members 12 and 14 act to hold applicator 10 releaseably closed. It is recognized that other fastening means may be used.

Figure 4:
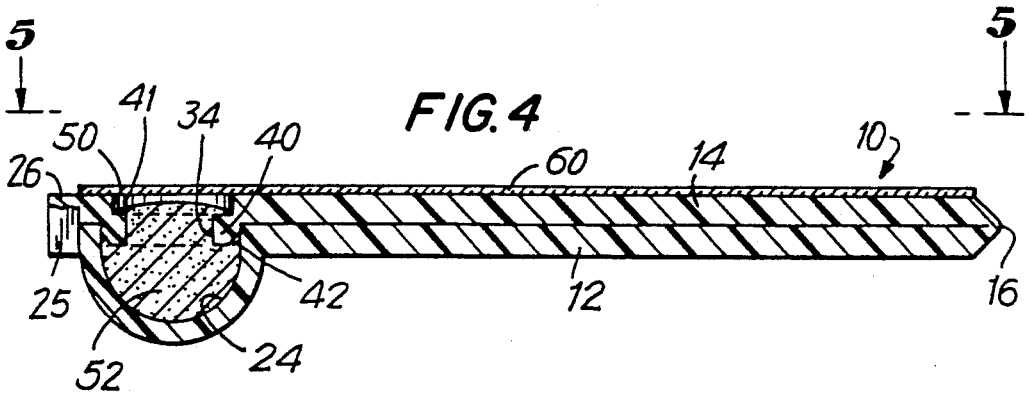
FIG. 4 is a sectional view similar to FIG. 3 showing the applicator filled with product and a label thereon.

Referring now to FIGS. 3 and 4, it is seen that second section 32 includes aperture 34 defined by an annular wall 40. The outer lower edge 42 of annular wall 40 is tapered as depicted, is raised beyond inner surface 31 of member 14 and is sized to fit partially within recessed portion 24 of first member 12. The taper permits easy insertion of wall 40 into recessed portion 24.

In addition, wall 40 defines an upper enlarged opening 50 which opens into aperture 24. After forming applicator 10 in the open condition depicted in FIGS. 1 and 2, the applicator is closed as depicted in FIG. 3. The product, preferably in a liquid state, is poured through opening 50 and aperture 34 into mold 24. A sufficient amount of the product is poured so that it rises above annular wall 40. When the product hardens, it remains anchored to second section 22 of member 12.

Specifically, FIG. 4 depicts cosmetic sampler 10 in the closed position after being filled with product 52. Product 52, which may be a cosmetic such as lipstick which liquifies when heated and forms a creamy product when cooled, fills mold 24 above wall 40 and spreads over the top surface 41 thereof, thereby anchoring product 52 to second member 12.

Figure 5:
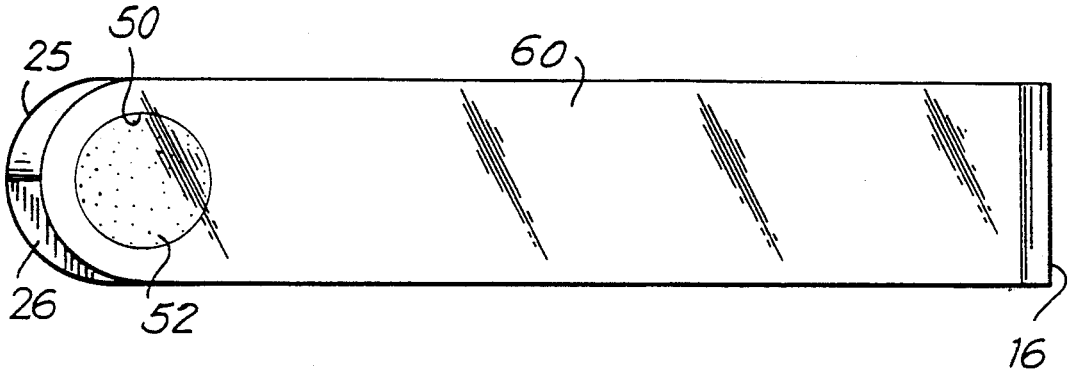
FIG. 5 is a top plan view taken along line 5—5 of FIG. 4.

After the filling process is completed, a label or seal 60 may be placed over opening 50 to cover aperture 24 and the product therein. In addition to carrying information about product 52, a portion or all of label 60 may be clear to permit viewing of the product. The label may be an adhesive label which maintains the integrity of the package in a sanitary condition, while allowing a user to view the precise color and nature of the cosmetic or other product before using the sample. This is best depicted in FIG. 5.

Figure 6:
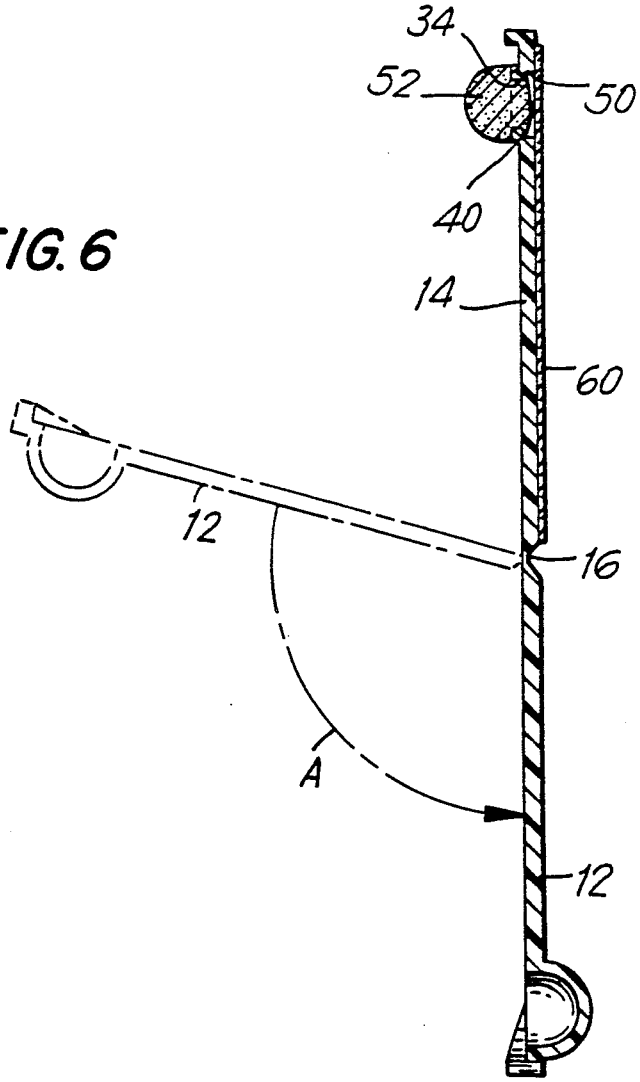
FIG. 6 is a sectional view showing the mold being removed from the formed product.

The beauty of the present invention is best appreciated with reference to FIG. 6. After product 52 has hardened, second section 22 of first member 12 can be moved away from second section 32 of second member 14 in the direction of arrow A thereby exposing the product for use. Product 52 is neatly formed and molded and is essentially fully exposed for use. After use, the applicator can be closed to protect the remaining product.

Thus, the present invention provides a neat mold and package for a cosmetic product or the like which is easy and inexpensive to manufacture and fill. Hence, the present invention meets its stated purpose to be a readily useable and disposable sample applicator.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A sampler applicator package forming and holding a predetermined amount of a product to be applied which permits direct application of said product comprising a cover member having a recessed portion defining a well, a second member releasably coupled to said cover member about said recessed portion and having an aperture in registration with said well when said cover member is coupled to said second member, said aperture being located about an axis, said second member being elongated in a direction essentially perpendicular to said axis to form a handle means for holding said second member, said product being poured through said aperture into said well, said product forming the shape of said well, and anchoring means for anchoring said product to said second member, said poured product remaining anchored to said second member and exposed for application when said cover member is removed from said second member, said cover member being replaceable over said second member to protect said product during storage.

2. The sampler applicator package as claimed in claim 1, wherein said anchoring means includes an annular wall surrounding said aperture.

3. The sampler applicator package as claimed in claim 2, wherein said second member includes a surface, at least a portion of said annular wall extending beyond the surface of said second member and into said well when said cover member is coupled to said second member.

4. The sampler applicator package as claimed in claim 3, wherein said annular wall defines an opening in alignment with said aperture, said opening being larger than said aperture.

5. The sampler applicator package as claimed in claim 3, wherein said annular wall includes a beveled outer edge.

6. The sampler applicator package as claimed in claim 1, wherein said well in said cover member is cup-shaped.

7. The sampler applicator package as claimed in claim 1, further comprising coupling means for releaseably coupling said cover member to said second member.

8. The sampler applicator package as claimed in claim 7, wherein said coupling means includes snap closures on said cover and second members.

9. The sampler applicator package as claimed in claim 1, further comprising sealing means for covering said aperture in said second member.

10. The sampler applicator package as claimed in claim 9, wherein said sealing means is transparent to permit viewing of said product.

11. The sampler applicator package as claimed in claim 1, wherein said well acts as a cover for said product when said product is anchored to said second member.

12. A sampler applicator package forming and holding a predetermined amount of a product to be applied which permits direct application of said product comprising a cover member having a recessed portion defining a well, a second member releasably coupled to said cover member about said recessed portion and having an aperture in registration with said well when said cover member is coupled to said second member, said product being poured through said aperture into said well, said product forming the shape of said well, and anchoring means for anchoring said product to said second member, said poured product remaining anchored to said second member and exposed for application when said cover member is removed from said second member, said cover member being replaceable over said second member to protect said product during storage, said cover and second members being molded integrally from a thermoplastic material with a living hinge hingedly coupling said cover and second members together.

13. The sampler applicator package as claimed in claim 12, wherein said thermoplastic material is polypropylene.

14. The sampler applicator package as claimed in claim 12, wherein said thermoplastic material is a relatively clear thermoplastic resin.

15. The sampler applicator package as claimed in claim 1, wherein said cover member is elongated.

16. A sampler applicator package which forms and holds a predetermined amount of a product which liquifies when heated and hardens when cooled comprising a cover member and an applicator member formed integrally from a thermoplastic material and hingedly joined together through a living hinge, said cover member having a recessed portion defining a well, said applicator member including an aperture in alignment with said well when said cover member is folded along said living hinge to lie adjacent said applicator member, said liquified product being poured through said aperture into said well, and anchoring means formed on said applicator member adjacent said aperture for anchoring said hardened product to said applicator member, said cover member being removable from lying adjacent said applicator member to permit application of said product, said cover member being replaceable to be adjacent said applicator member to protect said product during non-use.

17. The sampler applicator package as claimed in claim 16, wherein said anchoring means includes a raised wall surrounding said aperture.

18. A sampler applicator, as claimed in claim 17, wherein at least a portion of said raised wall extends beyond the surface of said applicator member and into said well when said cover member is folded along said living hinge.

19. The sampler applicator package as claimed in claim 18, wherein said raised wall defines an opening in alignment with said aperture, said opening being larger than said aperture.

* * * * *